United States Patent [19]

Hermes

[11] 4,388,764

[45] Jun. 21, 1983

[54] TEMPLATE GUIDE

[76] Inventor: Glenn P. Hermes, 295 E. River, New Braunfels, Tex. 78130

[21] Appl. No.: 328,013

[22] Filed: Dec. 7, 1981

[51] Int. Cl.[3] ..... B43L 13/00

[52] U.S. Cl. ..... 33/403; 33/174 B; 33/430

[58] Field of Search ..... 33/174 B, 23 D, 23 K, 33/438–441, 403, 430, 483–485, 464, 25 D

[56] References Cited

U.S. PATENT DOCUMENTS 3,316,644 5/1967 Baker et al. ..... 33/23 D X

FOREIGN PATENT DOCUMENTS 921010 1/1947 France ..... 33/492
934930 1/1948 France ..... 33/492
1288209 2/1962 France ..... 33/174 B
23909 of 1894 United Kingdom ..... 33/492

*Primary Examiner*—Harry N. Haroian
*Attorney, Agent, or Firm*—Gale R. Peterson

[57] ABSTRACT

A template guide for use with a parallel motion protractor or drafting machine having a substantially flat elongated base member with a longitudinal ridge extending substantially parallel to the edges of the base member and projecting normal to one surface of the base member, the ridge dividing said base member into first and second portions, the first portion being of a size efficient to cradle a drafting template and allow a drafting template to be moved longitudinally along the ridge parallel to a drafting arm of a parallel motion protractor, and the second portion being of a size efficient to cradle the drafting arm of a parallel motion protractor such that the ridge extends parallel to the edge of the drafting arm, and means for releasably securing the base member to the drafting arm such that the ridge is maintained parallel to the edge of the drafting arm.

6 Claims, 7 Drawing Figures

TEMPLATE GUIDE

BACKGROUND OF THE DISCLOSURE

This invention relates to a template guide for use with a parallel motion protractor or drafting machine, and in particular a template guide for lettering and numbering templates used in drafting operations, herein referred to as drafting templates.

Typically, drafting templates are moved along the edges of the drafting arm of a parallel motion protractor or drafting machine and a template follower bearing a drafting pin is used to follow the template and transfer the letters, numbers or other template data onto drafting media, for example paper or Mylar sheet.

A problem long existing in the art, however, is that as the template is guided along the edge of the drafting arm it causes the drafting media or paper to become soiled and also tends to smear wet ink. Moreover, the sliding template frequently damages the surface of the drafting media and leads to unacceptable drawings and illustrations.

Although the problem has long existed in the art, no one, prior to applicant, presented an acceptable solution.

SUMMARY OF THE INVENTION

The present invention obviates the problems of the past by providing a template guide adapted to be releasably secured to the drafting arm of a parallel motion protractor or drafting machine, and allows a drafting template to be moved along the entire length of a drafting arm without contact with the drafting media.

In essence, applicant's invention comprises a flat elongated base member formed of plastic or other suitable material which has a longitudinal ridge extending substantially parallel to the edges of the base member and projecting normal to one surface thereof. The ridge divides the base member into two portions.

The first portion is chosen to be of a size sufficient to cradle a drafting template. In other words, a size sufficient to allow the drafting template to move along the length of the base member as the template is held against the ridge. The base member protects the drafting media from the sliding template and the ridge provides an accurate guide for the template as it is held to one longitudinal edge of the drafting arm.

Various means, as hereinafter more fully disclosed, releasably secure the base member to the drafting arm.

It is therefore a principal object of the present invention to provide a template guide for use with a parallel motion protractor or drafting machine which provides an intermediate surface between a drafting template and the drafting media while maintaining a guide for the template parallel to the edge of a drafting arm.

It is further an object of the present invention to provide a template guide of simple, economical construction which is easily and quickly attached or removed from a drafting arm.

Other objects, features, and advantages of the invention will become evident in light of the following detailed description, viewed in conjunction with the referenced drawings, of a preferred exemplary template guide according to the invention. The foregoing and following description of the invention is for exemplary purposes only. The true spirit and scope of the invention is set forth in the appended claims.

DETAILED DESCRIPTION OF THE INVENTION

Figure 1:
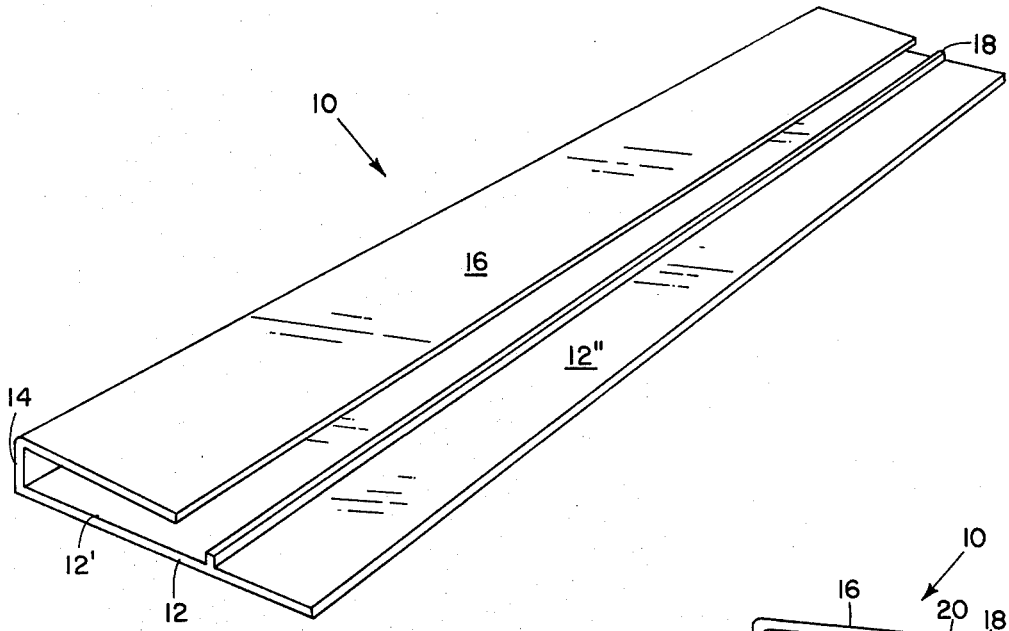
FIG. 1 is a perspective view of a first embodiment of a template guide according to the present invention.

Referring to FIG. 1, an exemplary first embodiment of a template guide according to the present invention 10 comprises a substantially flat elongated base member 12 having a longitudinal ridge 18 extending substantially parallel to the edges of base member 12 and projecting normal to the top surface thereof. Ridge 18 divides base member 12 into a first portion 12″ and a second portion 12′.

Figure 2:
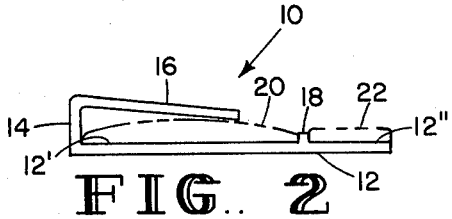
FIG. 2 is an end view of a first embodiment of a template guide according to the present invention shown in perspective in FIG. 1.

First portion 12″, as shown in FIG. 2, is chosen to have a size sufficient to cradle a drafting template 22 (shown in phantom line) and allow drafting template 22 to be moved longitudinally along ridge 18 parallel to the edge of a drafting arm 20 (shown in phantom line) of a parallel motion protractor or drafting machine. Second portion 12′ is chosen to be of a size sufficient to cradle a standard drafting arm of a parallel motion protractor or drafting machine such that ridge 18 bears against and is held parallel to the edge of drafting arm 20.

Template guide 10 may be formed of any suitable material, however a transparent plastic or acrylic material is preferred. Although it is not essential, it is particularly beneficial if portion 12″ is formed of a transparent material so as to allow a draftsman to view through the guide to material appearing on the drafting media.

As can be readily appreciated, first portion 12″ of template guide 10 protects the drafting media from the sliding of drafting template 2 along ridge 18 as it is moved to letter, number, or otherwise performed drafting functions. Yet, template 22 may be readily and easily lifted from the guide and either replaced with a different template or removed altogether. Moreover, it will be readily appreciated that the template guide need not be removed from the drafting arm as the outer edge of first portion 12″ of base member 12 provides a parallel edge to the longitudinal edge of drafting arm 20 and can be used for standard drafting techniques.

Figure 7:
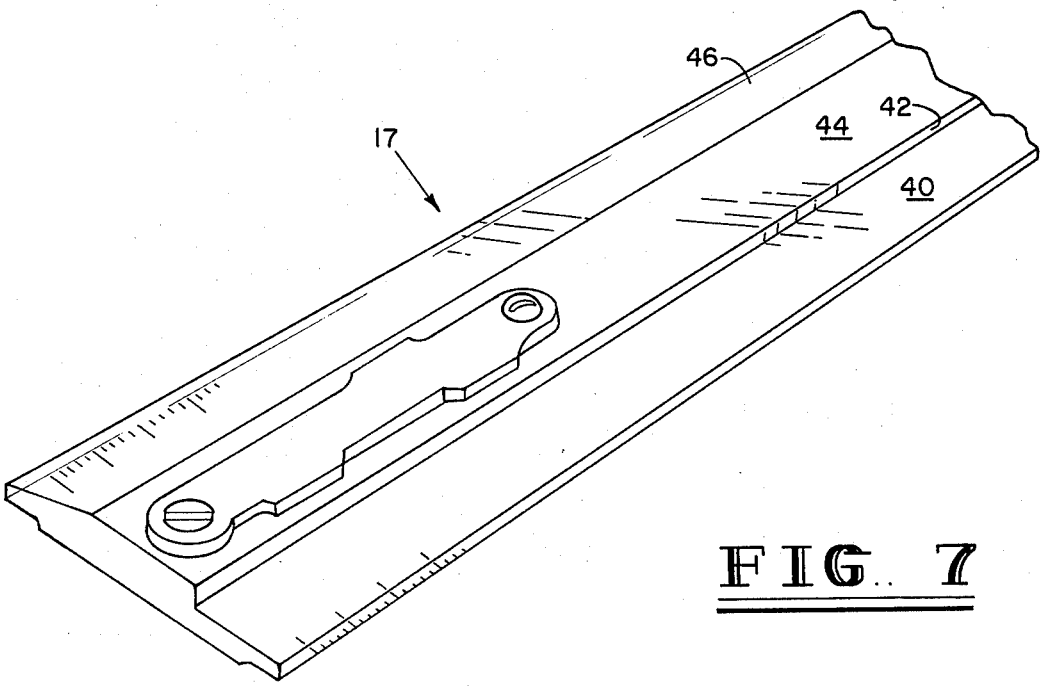
FIG. 7 is a fourth embodiment of the present invention.

The template guide of the present invention is preferably releasably secured to a drafting arm of a parallel motion protractor or drafting machine, however, as shown in FIG. 7 the template may be formed integrally with a drafting arm. Numerous alternative means may be used for releasably securing the template guide to a drafting arm, however, those means which Applicant has found particularly useful are shown in FIGS. 1–6.

Referring to FIG. 1 and FIG. 2, one exemplary means for releasably securing the template guide of the present invention to a drafting arm comprises forming an elevated member 14 projecting perpendicularly to flat base member 12 at the rear longitudinal edge thereof. Member 14 joins a flexible clamping member 16 at the upper edge thereof such that flexible clamping member 16 securely engages the top of a drafting arm 20 and holds it in secure engagement against ridge 18, base member 12, and elevated member 14.

Although elevated member 14 and clamping member 16 are illustrated in FIG. 1 is extending throughout the length of template guide 10, it will be readily appreciated that one or more elevated members and clamping members may be used in lieu thereof.

Figure 3:
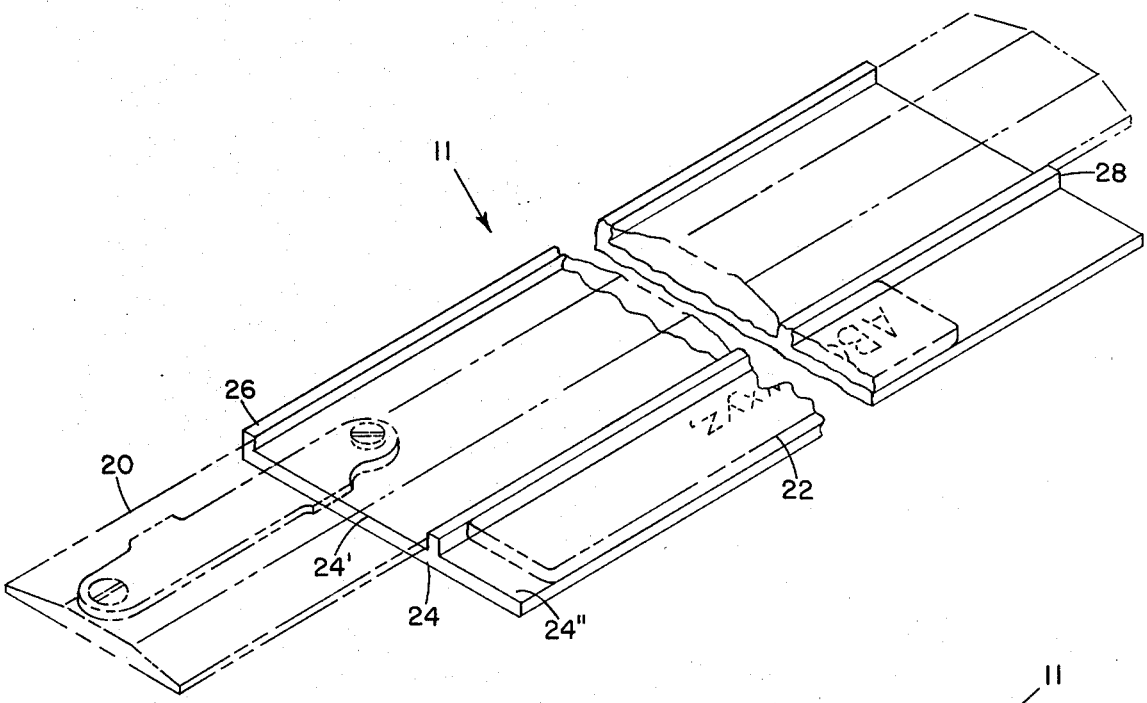
FIG. 3 is a perspective view of a second embodiment of a template guide according to the present invention.
Figure 4:
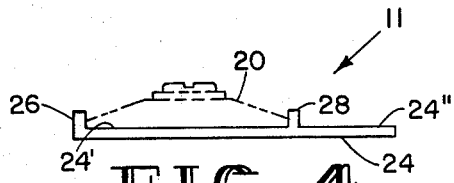
FIG. 4 is an end view of a second embodiment of a template guide according to the present invention viewed in perspective in FIG. 3.

A second alternative is illustrated in FIG. 3 and FIG. 4. Therein, a template guide according to the present invention 11 is formed of a substantially elongated base member 24 having a longitudinal ridge 28 extending substantially parallel to the edges of base member 24 and projecting normal to the upper surface thereof. As in FIG. 1 and FIG. 2 above, ridge 28 divides base member 24 into a first portion 24'' adapted to cradle a drafting template 22 (shown in phantom line) and a second portion 24' adapted to cradle a drafting arm 20 (shown in phantom line). In order to releasably secure template guide 11 on drafting arm 20 and maintain the longitudinal edge of drafting arm 20 in secure contact with ridge 28, a ridge 26 projecting perpendicularly to flat base member 24 is formed at the rear longitudinal edge thereof and runs parallel to ridge 28.

Figure 5:
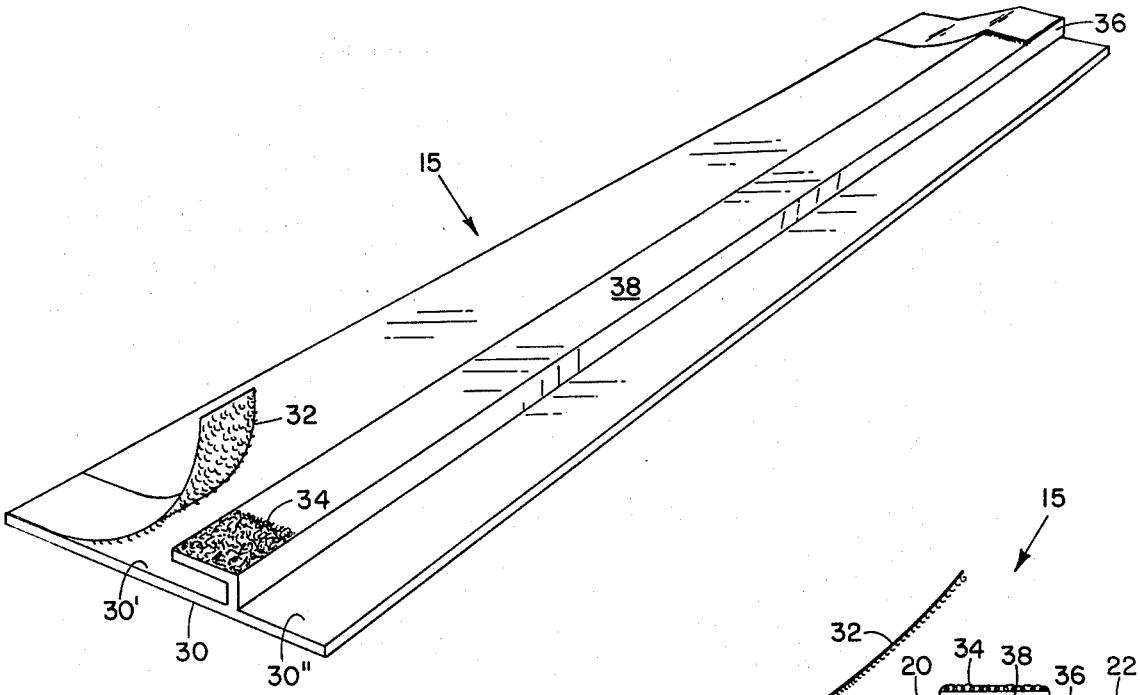
FIG. 5 is a third embodiment of a template guide according to the present invention.
Figure 6:
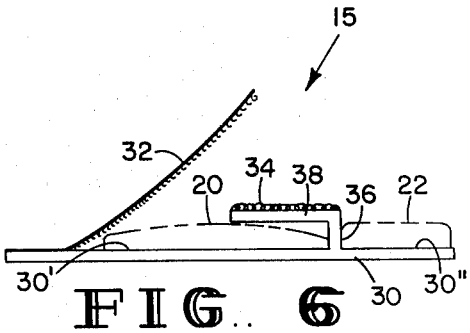
FIG. 6 is an end view of a third embodiment of the present invention as shown in perspective in FIG. 5.

Referring to FIG. 5, a third exemplary embodiment of a template guide according to the present invention 15 comprises a substantially flat elongated base member 30 having a longitudinal ridge 36 extending substantially parallel to the edges of base member 30 and projecting normal to the upper surface thereof. As in FIGS. 1–4, ridge 36 divides base member 30 into two portions, the first portion 30'' being of a size sufficient to cradle a drafting template 22 and allow the drafting template to be moved longitudinally along ridge 36 parallel to the edge of a drafting arm but without contact with an underlying drafting media. Second portion 30' is chosen to be of a size sufficient to cradle a drafting arm 20 as above. In this embodiment, the template guide according to the present invention 15 is releasably secured to a drafting arm 20 by providing a latch member 38 extending longitudinally and vertically spaced from base member 30 and joined with ridge 36 at one edge thereof. Suitable fastening means such as hook and loop fasteners 32 and 34 may be used to secure arm 20 in position and further force arm 20 into secure contact with ridge 36. Additionally, although not illustrated, a rear ridge such as 26 in FIG. 3 and FIG. 4 may be used.

As shown in FIG. 7, another embodiment of a template guide according to the present invention 17 comprises a parallel motion protractor drafting arm 44 having a rear slanted surface 46 as common on such arms, but with a substantially flat surface 40 formed along one longitudinal edge of the arm of sufficient size to cradle a drafting template and allow the drafting template to be moved parallel to the plane of the lower surface of drafting arm 44. A guide means 42 extending longitudinaly along the length of drafting arm 44 and parallel to the edge thereof allows the template to be moved parallel to the edge of the drafting arm.

Although the invention has been described in conjunction with the aforegoing specific embodiment, many alternatives, variations and modifications will be apparent to those of ordinary skill in the art. Those alternatives, variations and modifications are intended to fall within the spirit and scope of the appended claims.

I claim:

1. A template guide in combination with a drafting arm of a parallel motion protractor comprising:

a substantially flat elongated base member having a longitudinal ridge extending substantially parallel to the edges of said base member and projecting normal to one surface of said base member, said ridge dividing said base member into first and second portions, said first portion being of a size sufficient to cradle a drafting template and allow said drafting template to be moved longitudinally along said ridge parallel to said drafting arm of said parallel motion protractor, said second portion being of a size sufficient to cradle said drafting arm of said parallel motion protractor such that said ridge extends parallel to the edge of said drafting arm; and means for releasably securing said base member to said drafting arm such that said ridge is maintained parallel to the edge of said drafting arm.

2. A template guide as in claim 1 wherein said means for releasably securing said base member comprises at least one elevated member projecting perpendicularly to said flat base member at one longitudinal edge thereof and joining a flexible clamping member adapted to be secured over the top of said drafting arm.

3. A template guide as in claim 1 wherein said means for releasably securing said base member comprises a ridge projecting perpendicularly to said flat base member at one longitudinal edge thereof, parallel to said ridge dividing said base member into first and second portions whereby said drafting arm fits securely between said ridges.

4. A template guide as in claim 1 wherein said means for releasably securing said base member comprises a substantially flat latch member extending longitudinally and vertically spaced from said base member and joined with said ridge at one edge thereof.

5. A template guide as in claim 1 wherein said means for releasably securing said flat base member comprises a ridge projecting perpendicularly to said flat base member at one longitudinal edge thereof, parallel to said ridge dividing said base member into said first and second portions; and a substantially flat latch member extending longitudinally and vertically spaced from said base member and joined with said ridge at one edge thereof, whereby said drafting arm fits securely between said ridges.

6. A template guide as in claim 1 wherein said means for releasably securing said base member comprises a substantially flat latch member extending longitudinally and vertically spaced from said base member and joined with said ridge at one edge thereof; and having a hook and loop fastening means adapted to releasably secure said base member to said drafting arm.

* * * * *